US005460893A

United States Patent [19]

Teruuchi et al.

[11] Patent Number: 5,460,893

[45] Date of Patent: Oct. 24, 1995

[54] WEAR RESISTANT TITANIUM CARBONITRIDE-BASED CERMET CUTTING INSERT

[75] Inventors: Kiyohiro Teruuchi, Saitama; Katsuhiko Yano, Nigata; Niro Odani, Ibaragi, all of Japan

[73] Assignee: Mitsubishi Materials Corporation, Tokyo, Japan

[21] Appl. No.: 208,026

[22] Filed: Mar. 8, 1994

[30] Foreign Application Priority Data

Mar. 8, 1993 [JP] Japan ..... 5-073020

[51] Int. Cl.[6] ..... B22F 7/06

[52] U.S. Cl. ..... 428/552; 428/548; 428/546; 428/551

[58] Field of Search ..... 428/546, 548, 428/551, 552, 568, 569; 75/236, 237, 238, 233

[56] References Cited

U.S. PATENT DOCUMENTS

| | | | |
|---|---|---|---|
| 4,778,521 | 10/1988 | Iyori et al. | 75/237 |
| 5,053,074 | 10/1991 | Buljan et al. | 75/236 |
| 5,149,361 | 9/1992 | Iyori et al. | 75/233 |
| 5,186,739 | 2/1993 | Isoke et al. | 75/238 |
| 5,370,719 | 12/1994 | Teruuchi et al. | 51/309 |

FOREIGN PATENT DOCUMENTS

| | | |
|---|---|---|
| 63-297537 | 4/1989 | Japan . |
| 0273946 | 6/1990 | Japan . |
| 3226576 | 12/1991 | Japan . |
| 0681071 | 6/1994 | Japan . |

*Primary Examiner*—Donald P. Walsh
*Assistant Examiner*—John N. Greaves
*Attorney, Agent, or Firm*—Vineet Kohli; Thomas R. Morrison

[57] ABSTRACT

A TiCN-based cermet cutting insert superior in toughness with improved wear resistance includes a binding phase and at least two of four hard dispersion phases. One of the two hard dispersion phases includes at least one of a duplex or triplex phase structure with a core of a composite carbonitride solid solution and a single-phase structure of a composite carbonitride solid solution. The other hard dispersion phase includes one of a hard dispersion phase of titanium carbonitride and a hard dispersion phase which includes a single-phase structure of titanium carbonitride.

17 Claims, No Drawings

WEAR RESISTANT TITANIUM CARBONITRIDE-BASED CERMET CUTTING INSERT

BACKGROUND OF THE INVENTION

The present invention is directed to a cutting insert. More particularly, the present invention is directed to a titanium carbonitride-based cermet cutting insert (hereinafter referred to as TiCN), which exhibits superior wear resistance and toughness. Such a cutting insert is also longer lasting and resistant to damage such as chipping and breaking of the cutting edge while in continuous and discontinuous use.

In recent years, a demand for factory automation has created a need for longer lasting cutting inserts which are tough and wear resistant.

In an attempt to fulfill this demand for superior cutting inserts, Japanese Laid Open Patent Publication No. 62-170452 and 63-83241 discloses a TiCN-based cermet cutting insert which essentially contains from about 5 to about 30 vol % of a binding phase. The binding phase is mainly composed of Co and/or Ni, with the balance consisting of a hard dispersion phase.

The hard dispersion phase includes a duplex and/or a triplex phase structure with a core formed of a composite carbonitride solid solution (hereinafter referred to as (Ti, M)CN) composed of Ti and one or more elements selected from the group consisting of W, Mo, Cr, Ta, Nb, V, Hf, and Zr. This prior art cutting insert further contains a hard dispersion phase which includes a single phase structure composed of (Ti,M)CN.

Prior art TiCN-based cermet cutting inserts are plagued by numerous drawbacks. Chief among them is their inability to continuously cut steel in an industrial setting. Notwithstanding the toughness of prior art cutting inserts, such inserts are prone to extensive breakage and chipping of their cutting edges while continuously cutting steel. This drawback, in turn, impairs their usefulness and substantially shortens their lifespan.

The shortened life span, in turn, increases the overall cost of using prior art cutting inserts in both the cost of replacement of cutting inserts and the cost of machine downtime and labor to permit the replacement to be done.

OBJECTS AND SUMMARY OF THE INVENTION

Accordingly, it is an object of the present invention to provide a TiCN-based cermet cutting insert which exhibits superior toughness and wear resistance.

It is a further object of the invention to provide a TiCN-based cermet cutting insert which provides increased life, and substantially improved resistance to chipping and breaking of the cutting edge while continuously cutting steel.

Briefly stated, the present invention provides a wear resistant TiCN-based cermet cutting insert superior in toughness which includes a binding phase and at least two hard dispersion phases which coexist with each other.

One of the two hard dispersion phases includes at least one of a duplex or triplex phase structure with a core of a composite carbonitride solid solution and a single-phase structure of a composite carbonitride solid solution. The other hard dispersion phase includes one of a hard dispersion phase of titanium carbonitride and a hard dispersion phase which includes a single-phase structure of titanium carbonitride.

According to an embodiment of the invention, there is provided a wear-resistant cutting insert made of a titanium carbonitride-based cermet which includes a binding phase, which constitutes, by volume percent, from about 5 to about 30 percent of the titanium carbonitride-based cermet, the binding phase includes at least one of Ni and Co. The cutting insert also includes a first hard dispersion phase and a second hard dispersion phase.

The first hard dispersion phase is a combination of at least one of a hard dispersion phase, including at least one of a duplex and a triplex structure having a core of a carbonitride solid solution of titanium, and at least one element selected from the group consisting of Ta, Nb, V, Hf, Zr, W, Mo and Cr, and a hard dispersion phase including a single-phase structure formed of a composite carbonitride solid solution of titanium and at least one element selected from the group consisting of Ta, Nb, V, Hf, Zr, W, Mo and Cr.

The second hard dispersion phase, including at least one of a duplex and a triplex structure having a core of titanium carbonitride, and is present in an amount ranging from about 25 to about 70 volume percent of the titanium carbonitride-based cermet.

According to a feature of the present invention, there is provided a wear-resistant cutting insert made of a titanium carbonitride-based cermet which includes a binding phase, which constitutes, by volume percent, from about 5 to about 30 percent of the titanium carbonitride-based cermet, the binding phase includes at least one of Ni and Co. The cutting insert also includes a first hard dispersion phase and a second hard dispersion phase.

The first hard dispersion phase is a combination of at least one of a hard dispersion phase, including at least one of a duplex and a triplex structure having a core of a carbonitride solid solution of titanium, and at least one element selected from the group consisting of Ta, Nb, V, Hf, Zr, W, Mo and Cr and a hard dispersion phase, including a single-phase structure formed of a composite carbonitride solid solution of titanium, and at least one element selected from the group consisting of Ta, Nb, V, Hf, Zr, W, Mo and Cr.

The second hard dispersion phase includes a combination of at least one of a hard dispersion phase, including at least one of a duplex and a triplex structure having a core of titanium carbonitride, and a hard dispersion phase including a single-phase structure of titanium carbonitride, and is present in an amount from about 25 to about 70 volume percent of the total titanium carbonitride-based cermet.

According to yet another feature of the present invention, there is provided a wear resistant titanium carbonitride-based cermet cutting insert which includes a binding phase which constitutes, by volume percent, from about 5 to about 30 percent of the titanium carbonitride-based cermet, the binding phase includes at least one of Ni and Co. The cutting insert also includes a first hard dispersion phase and a second hard dispersion phase.

The first hard dispersion phase includes at least one of a duplex and a triplex structure, having a core of a carbonitride solid solution of titanium and at least one element selected from the group consisting of Ta, Nb, V, Hf, Zr, W, Mo and Cr.

The second hard dispersion phase includes a combination of at least one of a hard dispersion phase, including at least one of a duplex and a triplex structure having a core of titanium carbonitride, and a hard dispersion phase including a single-phase structure of titanium carbonitride and is present in an amount from about 25 to about 70 volume percent of the total titanium carbonitride-based cermet.

According to yet another feature of the present invention, there is provided a wear resistant titanium carbonitride-based cermet cutting insert which includes a binding phase, which constitutes, by volume percent, from about 5 to about 30 percent of the titanium carbonitride-based cermet, the binding phase includes at least one of Ni and Co. The cutting insert also includes a first hard dispersion phase and a second hard dispersion phase.

The first hard dispersion phase is at least one hard dispersion phase selected from the group consisting of a hard dispersion phase, including at least one of a duplex and a triplex structure having a core of a carbonitride solid solution of titanium, and at least one element selected from the group consisting of Ta, Nb, V, Hf, Zr, W, Mo and Cr and a hard dispersion phase including a single-phase structure formed of a composite carbonitride solid solution of titanium and at least one element selected from the group consisting of Ta, Nb, V, Hf, Zr, W, Mo and Cr.

The second hard dispersion phase is at least one of a hard dispersion phase including at least one of a duplex and a triplex structure having a core of titanium carbonitride and a hard dispersion phase, including a single-phase structure of titanium carbonitride and is present from about 25 to about 70 volume percent of the titanium carbonitride-based cermet.

According to another feature of the present invention, there is provided a wear-resistant cutting insert made of a titanium carbonitride-based cermet which includes a binding phase which constitutes, by volume percent, from about 5 to about 30 percent of the titanium carbonitride-based cermet, the binding phase includes at least one of Ni and Co. The binding phase also includes, by volume percent, no more than 10% of fine hard particles dispersed therein. The fine hard particles mainly contain TiN.

The cutting insert also includes a first hard dispersion phase and a second hard dispersion phase. The first hard dispersion phase is at least one selected from the group consisting of a hard dispersion phase, including at least one of a duplex and a triplex structure having a core of a carbonitride solid solution of titanium, and at least one element selected from the group consisting of Ta, Nb, V, Hf, Zr, W, Mo and Cr and a hard dispersion phase including a single-phase structure formed of a composite carbonitride solid solution of titanium and at least one element selected from the group consisting of Ta, Nb, V, Hf, Zr, W, Mo and Cr.

The second hard dispersion phase is at least one of a hard dispersion phase, including at least one of a duplex and a triplex structure having a core of titanium carbonitride and a hard dispersion phase including a single-phase structure of titanium carbonitride and is present in an amount from about 25 to about 70 volume percent of the total titanium carbonitride-based cermet.

The above, and other objects, features and advantages of the present invention will become apparent from the following description.

DETAILED DESCRIPTION OF THE PREFERRED EMBODIMENTS

Described hereinafter, is a brief summary of the composition of all four hard dispersion phases used in the cutting insert of the present invention.

A first hard dispersion phase includes a duplex and/or a triplex phase structure with a core formed of (Ti,M)CN (hereinafter referred to as A').

A second hard dispersion phase includes a single-phase structure which is composed of (Ti,M)CN (herein after referred to as A").

A third hard dispersion phase includes at least one of a duplex and/or a triplex phase structure characterized by a core structure composed of titanium carbonitride (hereinafter referred to as B').

A fourth hard dispersion phase includes a single-phase structure formed of titanium carbonitride (TiCN), (hereinafter referred to as B").

The inventors have discovered that a TiCN-based cermet cutting insert exhibits improved wear resistance and toughness when at least two hard dispersion phases, at least one of which is selected from the group consisting of A' and A" while the other hard dispersion phase is selected from the group consisting of B' and B", are combined with a binding phase composed substantially of Co or Ni.

It is preferable that at least one of the following combination of hard dispersion phases be used in conjunction with the binding phase: A', B' and B"; A', A" and B'; and A', A", B" and B".

In the TiCN-based cermet cutting insert of the present invention, the addition of at least one of B' and B" substantially improves the wear resistance of a TiCN-based cermet cutting insert, while the addition of at least one of an A" and A' in combination with the binding phase imparts substantial toughness to the TiCN-based cermet cutting insert. The improved toughness results from the coexistence of at least one of A' and A" with the binding phase composed of Co or Ni.

The resulting TiCN-based cermet cutting insert exhibits superior toughness and improved wear resistance to breakage and/or chipping of the cutting edge during both continuous and discontinuous use.

The coexistence of the hard phases such as at least one of A' and A" with at least one of B' and B" is enhanced by using TiCN powder and (Ti,M)CN powder. This coexistence is further enhanced by controlling the partial pressure of a nitrogen atmosphere at a sintering temperature of from about 1000° C. to about 1200° C., during which denitrification is extensive.

Similarly, the coexistence of the hard phases can be further enhanced by controlling the partial pressure of a nitrogen atmosphere at a sintering temperature above 1200° C., preferably between 1420° and 1600° C. By so doing, denitrification of TiCN is prevented. This feature also prevents at least one of W, Mo, Cr, Ta, Nb, V, Hf, and Zr from dissolving into TiCn.

The wear resistant TiCN-based cermet cutting insert comprises 5 to 30 vol % of a binding phase, with the balance comprising at least one of the four hard dispersion phases. The binding phase mainly includes at least one of Co and Ni.

The binding phase imparts toughness to the cutting insert. When the content of the binding phase falls below 5 vol %, superior toughness is not achieved. Similarly, when the binding phase content exceeds 30 vol %, the wear resistance is reduced.

The binding phase may include at least one element selected from the group consisting of W, Mo, Cr, Hf, Zr, Ti, Ta, Nb and V in an amount not more than 40 wt %. The addition of one of the above mentioned elements substantially improves wear resistance. Addition of the abovementioned element(s) in excess of 40 wt % reduces the toughness of the cutting insert.

Wear resistance can be further improved by strengthening the binding phase. This is achieved by dispersing about 10 vol % of fine hard particles composed of TiN, in the binding phase. These fine hard particles are added in addition to the two hard dispersion phases.

Addition of fine hard particles in excess of 10 vol %, is not preferred because this reduces the toughness of the cutting insert. It is preferable that the fine hard particles be present in an amount ranging from about 0.1 to about 10 vol %.

It is preferable that the total content of B' and B" be from about 25 to about 70 vol % of the TiCN-based cermet. The cutting insert exhibits insufficient wear resistance when B' alone or in combination with B" is present in an amount less the 25 vol %.

On the other hand, when the content of B' alone or in combination with B" exceeds 70 vol %, the wear resistance properties of the cutting insert is reduced. This, in turn, leads to easy chipping and breakage of the cutting insert.

This invention is illustrated in more detail by reference to the examples described hereinafter.

EXAMPLE 1

Material powders with varying compositions, as shown in Table 1 were prepared. Each of the various material powders contained numerous particles having a mean particle size ranging from about 0.5 to about 2 μm. Such material powders included powders of carbides, nitrides and carbonitrides, as well as powders of (Ti, M)CN, TiCN, Co and Ni.

Each of the compositions of Table 1 was compressed into green bodies, by being wet blended by a ball mill over a 72-hour period. After drying, the blended compositions were compression formed under a pressure of 1.5 ton/cm$^2$, to provide compressed green bodies.

The resulting green bodies were then sintered under either one of the following sintering condition:

NITROGEN ATMOSPHERE SINTERING

In this procedure, the compressed green bodies were heated from room temperature to 1100° C. in a nitrogen atmosphere at a nitrogen partial pressure of $10^{-2}$ torr. The partial pressure of nitrogen was increased to, and maintained at 10 torr for a period of time sufficient to heat the compacted green body from 1100° C. to a predetermined sintering temperature, of from 1420 to about 1600° C. The heated green body was maintained at the prescribed sintering temperature for a period of one hour and then cooled down to room temperature.

VACUUM SINTERING

In this procedure, the compacted green body was maintained for one hour at a predetermined temperature, ranging between 1420° and 1500° C. in a vacuum of $10^{-3}$ torr.

After sintering, sample nos. 1 to 18, of the present invention, listed in Table 1, were obtained, each having throw-away tips which were in compliance with SNMG 432. Additionally, comparative sample nos. 1 to 6, representing prior art TiCN-based cermet cutting inserts (hereinafter referred to as "conventional cutting inserts"), were also obtained.

In order to measure the content of the binding phase and the composition of the hard dispersion phases and their respective cores, the structures of the abovementioned samples were examined by means of an analytical electron microscope, an image analyzing apparatus and a scanning Auger electro-spectroscopic analyzer.

The areas of the respective hard phases were measured by an image analyzer. Scanning electro-microscopic photographs (magnification 4000) produced by the above mentioned scanning Auger electro-spectroscopic analyzer were obtained and volumes of the respective hard phases were calculated based upon the measured areas.

These samples were subjected to a discontinuous cutting test and a continuous cutting test which are described as follows:

Discontinuous cutting test included the following:

Cut material: Round bar of a steel SNCM 439 (hardness: HB 270), three longitudinal grooves were cut at three points equally spaced in a longitudinal direction along the bar.

Cutting speed: 150 m/min

Penetration: 2.8 mm

Feed: 0.3 mm/rev

Cutting time: 5 minutes

Continuous cutting test included the following:

Cut material: Round bar of steel SNCM 439 (hardness: HB 270)

Cutting speed: 200 m/min

Penetration: 2 mm

Feed: 0.3 mm/rev

Cutting time: 20 minutes

The width of wear on the relief surface on each sample was measured after completion of each of the abovementioned tests. The results including the proportions of the binding phase and the hard dispersion phases are reported in Table 2. The results pertaining to the analysis of the binding phase and the hard dispersion phases are reported in Tables 3–8.

TABLE 1

| TYPE | | COMPOSITION (WT %) Co | Ni | CARBIDE, NITRIDE, CARBO-NITRIDE | (Ti, M)CN | TiCN | SINTERING CONDITION |
|---|---|---|---|---|---|---|---|
| CUTTING | 1 | 10 | 10 | WC:10 | (Ti, Nb, V)CN:20 | Bal. | NITROGEN |
| INSERT OF THE | 2 | 5 | 10 | TiN:5, TaC:5, VC:5 | (Ti, W, Mo)CN:10, (Ti, Nb)CN:5 | Bal. | ATMOSPHERE |

TABLE 1-continued

| TYPE | | COMPOSITION (WT %) Co | Ni | CARBIDE, NITRIDE, CARBO-NITRIDE | (Ti, M)CN | TiCN | SINTERING CONDITION |
|---|---|---|---|---|---|---|---|
| INVENTION | 3 | 15 | 10 | WC:10, $Mo_2C$:5, NbCN:5 | (Ti, W, Mo)CN:10 | Bal. | |
| | 4 | — | 10 | TiN:10, $Mo_2C$10, HfC:1 | (Ti, W)CN:35, (Ti, Ta)CN:20 | Bal. | |
| | 5 | 10 | 5 | WC:10, TaC:15, $Cr_3C_2$:1 | (Ti, W, Mo)CN:35 | Bal. | |
| | 6 | 8 | 7 | WC:10, $Mo_2C$:10, NbC:5 | (Ti, W)CN:25, (Ti, Zr)CN:15 | Bal. | |
| | 7 | 5 | 10 | WC:10 | (Ti, W, Mo)CN:25, (Ti, V)CN:15 | Bal. | |
| | 8 | 15 | — | WC:10, $Mo_2C$:5 | (Ti, Ta)CN:30 | Bal. | |
| | 9 | 10 | 5 | TiN:5, WC:5, $Mo_2C$:5 | (Ti, W, Mo)CN:25, (Ti, Nb)CN:15 | Bal. | |
| | 10 | 8 | 7 | WC:10, $Mo_2C$:10, NbC:5 | (Ti, W, Mo)CN:10, (Ti, Nb)CN:5 | Bal. | |
| | 11 | 8 | 7 | WC:8, $Mo_2C$:8, NbC:4 | (Ti, W, Mo)CN:20, (Ti, Nb)CN:10 | Bal. | |
| | 12 | 8 | 7 | WC:6, $Mo_2C$:6, NbC:3 | (Ti, W, Mo)CN:30, (Ti, Nb)CN:15 | Bal. | |
| | 13 | 8 | 7 | WC:4, $Mo_2C$:4, NbC:2 | (Ti, W, Mo)CN:40, (Ti, Nb)CN:20 | Bal. | |
| | 14 | 10 | 5 | TiN:10, WC:10 | (Ti, Ta)CN:20, (Ti, Nb, V)CN:15 | Bal. | |
| | 15 | 8 | 7 | WC:20 | (Ti, Mo, Ta)CN:15 | Bal. | |
| | 16 | 8 | 7 | WC:15 | (Ti, Mo, Ta)CN:30 | Bal. | |
| | 17 | 8 | 7 | WC:10 | (Ti, Mo, Ta)CN:45 | Bal. | |
| | 18 | 8 | 7 | WC:5 | (Ti, Mo, Ta)CN:60 | Bal. | |
| CONVENTIONAL | 1 | 15 | 10 | WC:10, $Mo_2C$:5, NbCN:5 | (Ti, W, Mo)CN:Bal. | — | |
| CUTTING | 2 | 15 | — | WC:10, $Mo_2C$:5 | (Ti, Ta)CN:Bal. | — | |
| INSERT | 3 | 10 | 10 | WC:10 | (Ti, Nb, V)CN:Bal. | — | |
| | 4 | 10 | 5 | WC:10, TaC:15, $Cr_3C_2$:1 | (Ti, W, Mo)CN:35 | Bal. | VACUUM |
| | 5 | 8 | 7 | WC:10, $Mo_2C$:10, NbC:5 | (Ti, W)CN:25, (Ti, Zr)CN:15 | Bal. | |
| | 6 | — | 10 | TiN:10, $Mo_2C$10, HfC:1 | (Ti, W)CN:35, (Ti, Ta)CN:20 | Bal. | |

TABLE 2

| TYPE | | PROPORTION OF BINDING PHASE (VOL %) | PROPORTION TO HARD DISPERSION PHASE (VOL %) CORE TiCN DUPLEX | TRIPLEX | SINGLE | CORE (Ti, M)CN DUPLEX | TRIPLEX | SINGLE | FINE SINGLE PHASE COMPOSED OF TiN |
|---|---|---|---|---|---|---|---|---|---|
| CUTTING | 1 | 15 | — | 56 | 11 | 33 | — | — | — |
| INSERT OF THE | 2 | 10 | 56 | — | 10 | 11 | 19 | — | 4 |
| INVENTION | 3 | 21 | 30 | 30 | 7 | — | 33 | — | 13 |
| | 4 | 8 | 29 | — | — | 20 | 35 | 8 | 8 |
| | 5 | 12 | 32 | 21 | — | — | 38 | 9 | — |
| | 6 | 13 | 28 | 19 | — | 10 | 32 | 11 | — |
| | 7 | 12 | — | 41 | 13 | 13 | 26 | 7 | — |
| | 8 | 11 | 16 | 36 | 12 | 27 | — | 9 | — |
| | 9 | 13 | 24 | 17 | 8 | 11 | 23 | 13 | 4 |
| | 10 | 13 | 21 | 32 | 12 | 11 | 18 | 6 | — |
| | 11 | 13 | 17 | 26 | 10 | 15 | 25 | 7 | — |
| | 12 | 13 | 13 | 22 | 7 | 16 | 33 | 9 | — |
| | 13 | 13 | 9 | 16 | 5 | 19 | 42 | 9 | — |
| | 14 | 11 | — | 22 | 18 | 29 | — | 24 | 7 |
| | 15 | 13 | — | 51 | 13 | 30 | — | 6 | — |
| | 16 | 13 | — | 41 | 11 | 39 | — | 9 | — |
| | 17 | 13 | — | 32 | 8 | 49 | — | 11 | — |
| | 18 | 13 | — | 23 | 5 | 60 | — | 12 | — |
| CONVENTIONAL | 1 | 22 | — | — | — | — | 100 | — | — |
| CUTTING | 2 | 11 | — | — | — | 88 | — | 12 | — |
| INSERT | 3 | 11 | — | — | — | 91 | — | 9 | — |
| | 4 | 12 | — | — | — | — | 100 | — | — |
| | 5 | 12 | — | — | — | 63 | 37 | — | — |
| | 6 | 7 | — | — | — | 34 | 59 | 7 | — |

| TYPE | | WIDTH OF WEAR OF RELIEF SURFACE (mm) CONTINUOUS CUTTING | DISCONTINUOUS CUTTING |
|---|---|---|---|
| CUTTING | 1 | 0.32 | 0.35 |
| INSERT OF THE | 2 | 0.18 | 0.36 |
| INVENTION | 3 | 0.40 | 0.25 |
| | 4 | 0.20 | 0.37 |
| | 5 | 0.32 | 0.36 |
| | 6 | 0.34 | 0.33 |
| | 7 | 0.28 | 0.37 |

TABLE 2-continued

| | | | |
|---|---|---|---|
| | 8 | 0.24 | 0.40 |
| | 9 | 0.28 | 0.34 |
| | 10 | 0.25 | 0.40 |
| | 11 | 0.25 | 0.34 |
| | 12 | 0.31 | 0.32 |
| | 13 | 0.39 | 0.27 |
| | 14 | 0.18 | 0.38 |
| | 15 | 0.27 | 0.42 |
| | 16 | 0.28 | 0.35 |
| | 17 | 0.31 | 0.33 |
| | 18 | 0.40 | 0.28 |
| CONVENTIONAL CUTTING INSERT | 1 | 0.62 | 0.27 |
| | 2 | 0.58 | 0.29 |
| | 3 | 0.57 | 0.31 |
| | 4 | 0.56 | 0.31 |
| | 5 | 0.59 | 0.34 |
| | 6 | 0.52 | 0.39 |

TABLE 3

| TYPE | | COMPOSITION OF BINDING PHASE (WT %) | | | | | | | | | | |
|---|---|---|---|---|---|---|---|---|---|---|---|---|
| | | Co | Ni | Ti | Ta | Nb | V | Hf | Zr | W | Mo | Cr |
| CUTTING INSERT OF THE INVENTION | 1 | 46.9 | 44.0 | 1.4 | — | 0.5 | 0.3 | — | — | 6.9 | — | — |
| | 2 | 30.0 | 60.3 | 1.3 | 0.6 | 0.3 | 0.2 | — | — | 4.3 | 3.0 | — |
| | 3 | 55.8 | 35.1 | 0.7 | — | 0.4 | — | — | — | 5.2 | 2.8 | — |
| | 4 | — | 69.9 | 1.2 | 0.4 | — | — | 0.3 | — | 14.9 | 13.3 | — |
| | 5 | 40.8 | 22.6 | 0.4 | 1.0 | — | — | — | — | 25.2 | 10.0 | 0.0 |
| | 6 | 35.4 | 32.2 | 0.9 | — | 0.2 | — | — | 0.3 | 19.6 | 11.4 | — |
| | 7 | 26.3 | 49.2 | 1.3 | — | — | 0.3 | — | — | 17.1 | 5.8 | — |
| | 8 | 85.1 | — | 0.9 | 0.5 | — | — | — | — | 9.4 | 4.1 | — |
| | 9 | 51.0 | 23.7 | 1.1 | — | 0.5 | — | — | — | 12.6 | 11.1 | — |
| | 10 | 38.1 | 36.6 | 1.4 | — | 0.4 | — | — | — | 12.7 | 10.8 | — |
| | 11 | 37.4 | 37.2 | 0.9 | — | 0.5 | — | — | — | 12.4 | 11.6 | — |
| | 12 | 40.3 | 35.4 | 1.0 | — | 0.3 | — | — | — | 11.9 | 11.1 | — |
| | 13 | 38.3 | 36.5 | 0.5 | — | 0.4 | — | — | — | 13.4 | 10.9 | — |
| | 14 | 57.9 | 29.8 | 0.9 | 0.5 | 0.7 | 0.4 | — | — | 9.8 | — | — |
| | 15 | 43.5 | 36.5 | 1.3 | 0.8 | — | — | — | — | 13.8 | 4.1 | — |
| | 16 | 42.3 | 38.9 | 0.9 | 0.5 | — | — | — | — | 10.7 | 6.7 | — |
| | 17 | 44.7 | 37.4 | 0.4 | 0.4 | — | — | — | — | 7.3 | 9.8 | — |
| | 18 | 42.0 | 39.4 | 0.6 | 0.5 | — | — | — | — | 5.4 | 12.1 | — |
| CONVENTIONAL CUTTING INSERT | 1 | 37.5 | 26.4 | 0.4 | — | 0.2 | — | — | — | 21.2 | 14.3 | — |
| | 2 | 86.5 | — | 0.9 | 0.5 | — | — | — | — | 8.3 | 3.8 | — |
| | 3 | 42.8 | 45.0 | 0.6 | — | 0.3 | 0.3 | — | — | 11.0 | — | — |
| | 4 | 50.0 | 23.1 | 0.4 | 0.7 | — | — | — | — | 18.4 | 7.4 | 0.0 |
| | 5 | 42.1 | 34.5 | 0.5 | — | 0.4 | — | — | 0.0 | 14.3 | 8.2 | — |
| | 6 | — | 79.4 | 0.4 | 0.3 | — | — | 0.0 | — | 11.0 | 8.9 | — |

TABLE 4

| TYPE | | COMPOSITION OF DUPLEX HARD DISPERSION PHASE HAVING A CORE TiCN (WT %) | | | | | | | | | | | | | | | | | |
|---|---|---|---|---|---|---|---|---|---|---|---|---|---|---|---|---|---|---|---|
| | | CORE | | | | | | | | | SURROUNDING STRUCTURE | | | | | | | | |
| | | Ti | Ta | Nb | V | Hf | Zr | W | Mo | Cr | Ti | Ta | Nb | V | Hf | Zr | W | Mo | Cr |
| CUTTING INSERT OF THE INVENTION | 1 | — | — | — | — | — | — | — | — | — | — | — | — | — | — | — | — | — | — |
| | 2 | 100.0 | 0.0 | 0.0 | 0.0 | — | — | 0.0 | 0.0 | — | 72.7 | 11.9 | 2.8 | 6.4 | — | — | 3.7 | 2.5 | — |
| | 3 | 100.0 | — | 0.0 | — | — | — | 0.0 | 0.0 | — | 64.9 | — | 7.6 | — | — | — | 18.1 | 9.4 | — |
| | 4 | 100.0 | 0.0 | — | — | 0.0 | — | 0.0 | 0.0 | — | 68.6 | 2.2 | — | — | 0.7 | — | 4.1 | 24.4 | — |
| | 5 | 98.9 | 0.3 | — | — | — | — | 0.5 | 0.3 | 0.0 | 62.8 | 17.5 | — | — | — | — | 14.3 | 4.1 | 1.3 |
| | 6 | 98.8 | — | 0.0 | — | — | 0.0 | 0.7 | 0.5 | — | 69.9 | — | 6.1 | — | — | 1.7 | 11.4 | 10.9 | — |
| | 7 | — | — | — | — | — | — | — | — | — | — | — | — | — | — | — | — | — | — |
| | 8 | 100.0 | 0.0 | — | — | — | — | 0.0 | 0.0 | — | 66.1 | 5.3 | — | — | — | — | 19.4 | 9.2 | — |
| | 9 | 99.3 | — | 0.0 | — | — | — | 0.4 | 0.3 | — | 71.4 | — | 4.5 | — | — | — | 12.1 | 12.0 | — |
| | 10 | 100.0 | — | 0.0 | — | — | — | 0.0 | 0.0 | — | 60.6 | — | 8.3 | — | — | — | 15.0 | 16.1 | — |
| | 11 | 100.0 | — | 0.0 | — | — | — | 0.0 | 0.0 | — | 62.5 | — | 7.4 | — | — | — | 15.2 | 14.9 | — |
| | 12 | 100.0 | — | 0.0 | — | — | — | 0.0 | 0.0 | — | 60.6 | — | 8.1 | — | — | — | 14.8 | 16.5 | — |
| | 13 | 100.0 | — | 0.0 | — | — | — | 0.0 | 0.0 | — | 60.9 | — | 9.0 | — | — | — | 14.8 | 15.3 | — |

TABLE 4-continued

| TYPE | | COMPOSITION OF DUPLEX HARD DISPERSION PHASE HAVING A CORE TiCN (WT %) | | | | | | | | | | | | | | | | |
|---|---|---|---|---|---|---|---|---|---|---|---|---|---|---|---|---|---|---|
| | | CORE | | | | | | | | | SURROUNDING STRUCTURE | | | | | | | |
| | | Ti | Ta | Nb | V | Hf | Zr | W | Mo | Cr | Ti | Ta | Nb | V | Hf | Zr | W | Mo | Cr |
| | 14 | 99.2 | 0.0 | 0.0 | 0.0 | — | — | 0.8 | — | — | 64.8 | 10.3 | 8.1 | 1.6 | — | — | 15.2 | — | — |
| | 15 | 100.0 | 0.0 | — | — | — | — | 0.0 | 0.0 | — | 71.3 | 8.2 | — | — | — | — | 9.2 | 11.3 | — |
| | 16 | 100.0 | 0.0 | — | — | — | — | 0.0 | 0.0 | — | 70.2 | 7.9 | — | — | — | — | 10.4 | 11.5 | — |
| | 17 | 100.0 | 0.0 | — | — | — | — | 0.0 | 0.0 | — | 72.8 | 7.3 | — | — | — | — | 9.3 | 10.6 | — |
| | 18 | 100.0 | 0.0 | — | — | — | — | 0.0 | 0.0 | — | 70.0 | 8.5 | — | — | — | — | 10.1 | 11.4 | — |

TABLE 5

| TYPE | | COMPOSITION OF TRIPLEX HARD DISPERSION PHASE HAVING A CORE TiCN (WT %) | | | | | | | | | | | | | | | | | |
|---|---|---|---|---|---|---|---|---|---|---|---|---|---|---|---|---|---|---|---|
| | | CORE | | | | | | | | | INTERMEDIATE LAYER | | | | | | | | |
| | | Ti | Ta | Nb | V | Hf | Zr | W | Mo | Cr | Ti | Ta | Nb | V | Hf | Zr | W | Mo | Cr |
| CUTTING INSERT OF THE INVENTION | 1 | 100.0 | — | 0.0 | 0.0 | — | — | 0.0 | — | — | 66.6 | — | 3.4 | 0.5 | — | — | 29.5 | — | — |
| | 2 | — | — | — | — | — | — | — | — | — | — | — | — | — | — | — | — | — | — |
| | 3 | 100.0 | — | 0.0 | — | — | — | 0.0 | 0.0 | — | 58.9 | — | 9.4 | — | — | — | 24.4 | 7.3 | — |
| | 4 | — | — | — | — | — | — | — | — | — | — | — | — | — | — | — | — | — | — |
| | 5 | 98.4 | 0.7 | — | — | — | — | 0.9 | 0.0 | 0.0 | 53.9 | 25.3 | — | — | — | — | 18.1 | 2.3 | 0.4 |
| | 6 | 96.5 | — | 0.4 | — | — | 0.0 | 2.2 | 0.9 | — | 57.0 | — | 9.5 | — | — | 0.0 | 19.2 | 14.3 | — |
| | 7 | 99.2 | — | — | 0.0 | — | — | 0.8 | 0.0 | — | 64.4 | — | — | 0.0 | — | — | 33.5 | 2.1 | — |
| | 8 | 100.0 | 0.0 | — | — | — | — | 0.0 | 0.0 | — | 58.3 | 2.9 | — | — | — | — | 28.1 | 10.7 | — |
| | 9 | 99.1 | — | 0.0 | — | — | — | 0.5 | 0.4 | — | 57.9 | — | 2.4 | — | — | — | 21.8 | 17.9 | — |
| | 10 | 100.0 | — | 0.0 | — | — | — | 0.0 | 0.0 | — | 54.4 | — | 10.1 | — | — | — | 21.2 | 14.3 | — |
| | 11 | 100.0 | — | 0.0 | — | — | — | 0.0 | 0.0 | — | 54.4 | — | 9.8 | — | — | — | 20.3 | 15.5 | — |
| | 12 | 100.0 | — | 0.0 | — | — | — | 0.0 | 0.0 | — | 53.7 | — | 11.3 | — | — | — | 20.9 | 14.1 | — |
| | 13 | 100.0 | — | 0.0 | — | — | — | 0.0 | 0.0 | — | 53.3 | — | 10.4 | — | — | — | 21.4 | 14.9 | — |
| | 14 | 98.9 | 0.0 | 0.0 | 0.0 | — | — | 1.1 | — | — | 62.3 | 4.2 | 3.1 | 0.0 | — | — | 30.4 | — | — |
| | 15 | 100.0 | 0.0 | — | — | — | — | 0.0 | 0.0 | — | 45.3 | 10.4 | — | — | — | — | 31.3 | 13.0 | — |
| | 16 | 100.0 | 0.0 | — | — | — | — | 0.0 | 0.0 | — | 47.7 | 9.7 | — | — | — | — | 30.5 | 12.1 | — |
| | 17 | 100.0 | 0.0 | — | — | — | — | 0.0 | 0.0 | — | 46.7 | 9.8 | — | — | — | — | 29.8 | 13.7 | — |
| | 18 | 100.0 | 0.0 | — | — | — | — | 0.0 | 0.0 | — | 45.5 | 10.0 | — | — | — | — | 32.1 | 12.4 | — |

| TYPE | | COMPOSITION OF TRIPLEX HARD DISPERSION PHASE HAVING A CORE TiCN (WT %) | | | | | | | | |
|---|---|---|---|---|---|---|---|---|---|---|
| | | SURROUNDING STRUCTURE | | | | | | | | |
| | | Ti | Ta | Nb | V | Hf | Zr | W | Mo | Cr |
| CUTTING INSERT OF THE INVENTION | 1 | 77.2 | — | 1.2 | 0.4 | — | — | 21.2 | — | — |
| | 2 | — | — | — | — | — | — | — | — | — |
| | 3 | 69.7 | — | 5.9 | — | — | — | 18.1 | 6.3 | — |
| | 4 | — | — | — | — | — | — | — | — | — |
| | 5 | 69.1 | 17.6 | — | — | — | — | 9.2 | 3.2 | 0.9 |
| | 6 | 71.9 | — | 5.3 | — | — | 0.9 | 10.2 | 11.7 | — |
| | 7 | 76.5 | — | — | 0.6 | — | — | 21.1 | 1.8 | — |
| | 8 | 69.8 | 4.4 | — | — | — | — | 17.3 | 8.5 | — |
| | 9 | 75.4 | — | 2.3 | — | — | — | 10.4 | 11.9 | — |
| | 10 | 68.0 | — | 6.0 | — | — | — | 13.1 | 12.9 | — |
| | 11 | 69.7 | — | 4.9 | — | — | — | 13.0 | 12.4 | — |
| | 12 | 68.8 | — | 5.3 | — | — | — | 12.5 | 13.4 | — |
| | 13 | 68.8 | — | 5.8 | — | — | — | 12.1 | 13.3 | — |
| | 14 | 79.4 | 3.2 | 3.2 | 0.8 | — | — | 13.4 | — | — |
| | 15 | 71.3 | 8.1 | — | — | — | — | 17.3 | 8.3 | — |
| | 16 | 71.4 | 7.0 | — | — | — | — | 12.3 | 8.7 | — |
| | 17 | 72.0 | 8.4 | — | — | — | — | 11.7 | 7.9 | — |
| | 18 | 30.2 | 7.9 | — | — | — | — | 13.1 | 8.8 | — |

TABLE 6

| TYPE | | COMPOSITION OF DUPLEX HARD DISPERSION PHASE HAVING A CORE (Ti, M)CN (WT %) | | | | | | | | | | | | | | | | |
|---|---|---|---|---|---|---|---|---|---|---|---|---|---|---|---|---|---|---|
| | | CORE | | | | | | | | | SURROUNDING STRUCTURE | | | | | | | |
| | | Ti | Ta | Nb | V | Hf | Zr | W | Mo | Cr | Ti | Ta | Nb | V | Hf | Zr | W | Mo | Cr |
| CUTTING INSERT OF THE INVENTION | 1 | 40.8 | — | 16.8 | 4.5 | — | — | 32.9 | — | — | 69.1 | — | 11.6 | 3.4 | — | — | 15.9 | — | — |
| | 2 | 69.8 | 6.7 | 3.5 | 4.1 | — | — | 10.3 | 5.6 | — | 60.4 | 9.4 | 4.0 | 5.5 | — | — | 13.8 | 6.9 | — |
| | 3 | — | — | — | — | — | — | — | — | — | — | — | — | — | — | — | — | — | — |
| | 4 | 69.8 | 11.0 | — | — | 1.5 | — | 13.5 | 4.2 | — | 61.8 | 15.2 | — | — | 1.8 | — | 15.4 | 5.8 | — |
| | 5 | — | — | — | — | — | — | — | — | — | — | — | — | — | — | — | — | — | — |
| | 6 | 46.9 | — | 7.8 | — | — | 3.5 | 30.1 | 11.7 | — | 64.8 | — | 5.3 | — | — | 4.3 | 19.5 | 6.1 | — |
| | 7 | 77.8 | — | — | 5.3 | — | — | 14.2 | 2.7 | — | 63.6 | — | — | 6.8 | — | — | 18.2 | 11.4 | — |
| | 8 | 72.6 | 12.6 | — | — | — | — | 9.2 | 5.6 | — | 61.3 | 13.3 | — | — | — | — | 17.3 | 8.1 | — |
| | 9 | 71.9 | — | 5.3 | — | — | — | 14.6 | 8.2 | — | 61.1 | — | 5.3 | — | — | — | 20.2 | 13.4 | — |
| | 10 | 63.1 | — | 7.5 | — | — | — | 15.3 | 14.1 | — | 54.5 | — | 7.1 | — | — | — | 18.7 | 19.7 | — |
| | 11 | 64.8 | — | 7.6 | — | — | — | 13.4 | 14.2 | — | 53.4 | — | 8.5 | — | — | — | 19.8 | 18.3 | — |
| | 12 | 62.9 | — | 7.3 | — | — | — | 14.8 | 15.0 | — | 53.1 | — | 8.7 | — | — | — | 18.8 | 19.4 | — |
| | 13 | 65.5 | — | 6.9 | — | — | — | 13.3 | 14.3 | — | 55.1 | — | 8.4 | — | — | — | 18.4 | 18.1 | — |
| | 14 | 66.1 | 15.1 | 10.8 | 3.2 | — | — | 4.8 | — | — | 55.3 | 14.3 | 9.6 | 2.9 | — | — | 17.9 | — | — |
| | 15 | 44.7 | 25.4 | — | — | — | — | 2.9 | 27.0 | — | 69.6 | 10.5 | — | — | — | — | 6.5 | 13.4 | — |
| | 16 | 45.8 | 25.6 | — | — | — | — | 2.2 | 26.4 | — | 70.4 | 10.9 | — | — | — | — | 5.7 | 13.0 | — |
| | 17 | 45.1 | 26.0 | — | — | — | — | 2.4 | 26.5 | — | 71.8 | 10.2 | — | — | — | — | 5.9 | 12.1 | — |
| | 18 | 45.2 | 24.7 | — | — | — | — | 2.5 | 27.6 | — | 72.0 | 11.3 | — | — | — | — | 4.2 | 12.5 | — |
| CONVENTIONAL CUTTING INSERT | 1 | — | — | — | — | — | — | — | — | — | — | — | — | — | — | — | — | — | — |
| | 2 | 72.3 | 18.4 | — | — | — | — | 6.4 | 2.9 | — | 54.4 | 21.3 | — | — | — | — | 16.0 | 8.3 | — |
| | 3 | 73.1 | — | 18.2 | 5.4 | — | — | 3.3 | — | — | 64.4 | — | 23.4 | 8.1 | — | — | 4.1 | — | — |
| | 4 | — | — | — | — | — | — | — | — | — | — | — | — | — | — | — | — | — | — |
| | 5 | 48.3 | — | 5.0 | — | — | 3.2 | 31.3 | 12.2 | — | 63.7 | — | 4.0 | — | — | 3.6 | 21.3 | 7.4 | — |
| | 6 | 67.1 | 11.0 | — | — | 1.0 | — | 16.1 | 4.8 | — | 59.0 | 10.5 | — | — | 0.8 | — | 21.5 | 8.2 | — |

TABLE 5

| TYPE | | COMPOSITION OF TRIPLEX HARD DISPERSION PHASE HAVING A CORE (Ti, M)CN (WT %) | | | | | | | | | | | | | | | | | |
|---|---|---|---|---|---|---|---|---|---|---|---|---|---|---|---|---|---|---|---|
| | | CORE | | | | | | | | | INTERMEDIATE LAYER | | | | | | | | |
| | | Ti | Ta | Nb | V | Hf | Zr | W | Mo | Cr | Ti | Ta | Nb | V | Hf | Zr | W | Mo | Cr |
| CUTTING INSERT OF THE INVENTION | 1 | — | — | — | — | — | — | — | — | — | — | — | — | — | — | — | — | — | — |
| | 2 | 73.1 | 2.3 | 4.4 | 1.3 | — | — | 11.5 | 7.4 | — | 56.7 | 10.8 | 5.3 | 4.1 | — | — | 15.2 | 7.9 | — |
| | 3 | 72.1 | — | 4.4 | — | — | — | 15.3 | 8.2 | — | 58.9 | — | 7.4 | — | — | — | 22.4 | 11.3 | — |
| | 4 | 72.7 | 12.6 | — | — | 0.6 | — | 11.3 | 2.8 | — | 55.5 | 15.4 | — | — | 0.7 | — | 19.1 | 9.3 | — |
| | 5 | 70.8 | 5.2 | — | — | — | — | 12.5 | 11.1 | 0.4 | 46.9 | 18.1 | — | — | — | — | 21.3 | 12.8 | 0.9 |
| | 6 | 76.1 | — | 0.7 | — | — | 6.7 | 15.3 | 1.2 | — | 56.2 | — | 3.1 | — | — | 4.6 | 26.7 | 9.4 | — |
| | 7 | 75.3 | — | — | 6.4 | — | — | 13.1 | 5.2 | — | 59.1 | — | — | 4.8 | — | — | 24.3 | 11.8 | — |
| | 8 | — | — | — | — | — | — | — | — | — | — | — | — | — | — | — | — | — | — |
| | 9 | 70.1 | — | 6.1 | — | — | — | 15.3 | 8.5 | — | 54.7 | — | 6.4 | — | — | — | 23.2 | 15.7 | — |
| | 10 | 63.5 | — | 6.7 | — | — | — | 15.0 | 14.8 | — | 45.6 | — | 9.9 | — | — | — | 23.8 | 20.7 | — |
| | 11 | 64.6 | — | 7.2 | — | — | — | 13.1 | 15.1 | — | 45.6 | — | 9.7 | — | — | — | 25.4 | 19.3 | — |
| | 12 | 63.1 | — | 7.8 | — | — | — | 14.4 | 14.7 | — | 43.9 | — | 10.9 | — | — | — | 24.7 | 20.5 | — |
| | 13 | 65.9 | — | 6.9 | — | — | — | 13.4 | 13.8 | — | 47.0 | — | 10.2 | — | — | — | 24.3 | 18.5 | — |
| | 14 | 66.9 | 14.9 | 11.4 | 3.0 | — | — | 3.8 | — | — | 48.7 | 16.4 | 11.1 | 4.1 | — | — | 19.7 | — | — |
| | 15 | 59.3 | 18.6 | — | — | — | — | 1.9 | 20.2 | — | 39.7 | 24.1 | — | — | — | — | 10.9 | 25.3 | — |
| | 16 | 62.0 | 18.3 | — | — | — | — | 1.4 | 18.3 | — | 40.2 | 25.3 | — | — | — | — | 9.7 | 24.8 | — |
| | 17 | 59.3 | 18.7 | — | — | — | — | 2.1 | 19.9 | — | 39.1 | 24.8 | — | — | — | — | 10.4 | 25.7 | — |
| | 18 | 59.1 | 19.5 | — | — | — | — | 1.4 | 20.0 | — | 40.3 | 25.7 | — | — | — | — | 10.0 | 24.0 | — |
| CONVENTIONAL CUTTING INSERT | 1 | 73.8 | — | 4.1 | — | — | — | 14.8 | 7.3 | — | 53.2 | — | 5.4 | — | — | — | 25.4 | 16.0 | — |
| | 2 | — | — | — | — | — | — | — | — | — | — | — | — | — | — | — | — | — | — |
| | 3 | — | — | — | — | — | — | — | — | — | — | — | — | — | — | — | — | — | — |
| | 4 | 67.1 | 5.7 | — | — | — | — | 15.4 | 11.3 | 0.5 | 50.6 | 17.1 | — | — | — | — | 20.4 | 11.1 | 0.8 |
| | 5 | 68.4 | — | 1.6 | — | — | 9.2 | 17.7 | 3.1 | — | 46.1 | — | 3.7 | — | — | 8.8 | 27.9 | 13.5 | — |
| | 6 | 72.0 | 12.1 | — | — | 0.4 | — | 13.3 | 2.2 | — | 51.6 | 14.3 | — | — | 0.6 | — | 18.2 | 15.3 | — |

| TYPE | | COMPOSITION OF TRIPLEX HARD DISPERSION PHASE HAVING A CORE (Ti, M)CN (WT %) | | | | | | | | |
|---|---|---|---|---|---|---|---|---|---|---|
| | | SURROUNDING STRUCTURE | | | | | | | | |
| | | Ti | Ta | Nb | V | Hf | Zr | W | Mo | Cr |
| CUTTING INSERT OF THE INVENTION | 1 | — | — | — | — | — | — | — | — | — |
| | 2 | 65.8 | 5.4 | 4.8 | 3.8 | — | — | 12.1 | 8.1 | — |
| | 3 | 66.5 | — | 5.2 | — | — | — | 16.2 | 12.1 | — |

TABLE 5-continued

| | | | | | | | | | | |
|---|---|---|---|---|---|---|---|---|---|---|
| | 4 | 65.5 | 13.9 | — | — | 0.7 | — | 15.1 | 4.8 | — |
| | 5 | 61.8 | 8.1 | — | — | — | — | 15.3 | 13.7 | 1.1 |
| | 6 | 65.4 | — | 3.1 | — | — | 5.4 | 21.3 | 4.8 | — |
| | 7 | 65.8 | — | — | 5.4 | — | — | 19.2 | 9.6 | — |
| | 8 | — | — | — | — | — | — | — | — | — |
| | 9 | 63.9 | — | 5.7 | — | — | — | 18.1 | 12.3 | — |
| | 10 | 60.9 | — | 7.1 | — | — | — | 15.2 | 16.8 | — |
| | 11 | 58.5 | — | 7.4 | — | — | — | 16.8 | 17.3 | — |
| | 12 | 60.7 | — | 7.8 | — | — | — | 15.7 | 15.8 | — |
| | 13 | 60.8 | — | 7.2 | — | — | — | 15.1 | 16.9 | — |
| | 14 | 64.8 | 11.4 | 8.7 | 2.5 | — | — | 12.6 | — | — |
| | 15 | 60.5 | 9.0 | — | — | — | — | 15.3 | 15.2 | — |
| | 16 | 62.0 | 9.4 | — | — | — | — | 14.2 | 14.4 | — |
| | 17 | 61.5 | 9.7 | — | — | — | — | 15.1 | 13.7 | — |
| | 18 | 62.3 | 9.1 | — | — | — | — | 13.9 | 14.7 | — |
| CONVENTIONAL | 1 | 66.2 | — | 8.3 | — | — | — | 16.4 | 9.1 | — |
| CUTTING | 2 | — | — | — | — | — | — | — | — | — |
| INSERT | 3 | — | — | — | — | — | — | — | — | — |
| | 4 | 61.8 | 8.4 | — | — | — | — | 17.9 | 10.6 | 1.3 |
| | 5 | 57.8 | — | 2.4 | — | — | 10.1 | 21.4 | 8.3 | — |
| | 6 | 64.4 | 10.8 | — | — | 0.6 | — | 15.9 | 8.3 | — |

TABLE 8

| | | COMPOSITION OF SINGLE HARD DISPERSION PHASE (WT %) | | | | | | | | | | | | | | | | | |
|---|---|---|---|---|---|---|---|---|---|---|---|---|---|---|---|---|---|---|---|
| | | TiCN | | | | | | | | | (Ti, M)CN | | | | | | | | |
| TYPE | | Ti | Ta | Nb | V | Hf | Zr | W | Mo | Cr | Ti | Ta | Nb | V | Hf | Zr | W | Mo | Cr |
| CUTTING | 1 | 100.0 | — | — | — | — | — | 0.0 | — | — | — | — | — | — | — | — | — | — | — |
| INSERT OF THE | 2 | 100.0 | 0.0 | 0.0 | 0.0 | — | — | 0.0 | 0.0 | — | — | — | — | — | — | — | — | — | — |
| INVENTION | 3 | 99.3 | — | 0.0 | — | — | — | 0.7 | 0.0 | — | — | — | — | — | — | — | — | — | — |
| | 4 | — | — | — | — | — | — | — | — | — | 70.4 | 14.3 | — | — | 0.4 | — | 12.4 | 2.5 | — |
| | 5 | — | — | — | — | — | — | — | — | — | 67.2 | 4.3 | — | — | — | — | 15.2 | 13.3 | 0.0 |
| | 6 | — | — | — | — | — | — | — | — | — | 73.9 | — | 0.6 | — | — | 6.8 | 16.1 | 2.6 | — |
| | 7 | 100.0 | — | — | 0.0 | — | — | 0.0 | 0.0 | — | 70.0 | — | — | 7.5 | — | — | 14.3 | 8.2 | — |
| | 8 | 100.0 | 0.0 | — | — | — | — | 0.0 | 0.0 | — | 73.0 | 16.2 | — | — | — | — | 6.4 | 4.4 | — |
| | 9 | 98.3 | — | 0.0 | — | — | — | 1.1 | 0.6 | — | 66.4 | — | 8.2 | — | — | — | 17.1 | 8.3 | — |
| | 10 | 100.0 | — | 0.0 | — | — | — | 0.0 | 0.0 | — | 64.2 | — | 7.1 | — | — | — | 14.8 | 13.9 | — |
| | 11 | 100.0 | — | 0.0 | — | — | — | 0.0 | 0.0 | — | 65.7 | — | 6.9 | — | — | — | 13.0 | 14.4 | — |
| | 12 | 100.0 | — | 0.0 | — | — | — | 0.0 | 0.0 | — | 64.5 | — | 7.4 | — | — | — | 14.1 | 14.0 | — |
| | 13 | 100.0 | — | 0.0 | — | — | — | 0.0 | 0.0 | — | 66.7 | — | 6.6 | — | — | — | 13.5 | 13.2 | — |
| | 14 | 99.1 | 0.0 | 0.0 | 0.0 | — | — | 0.9 | — | — | 66.0 | 15.1 | 12.6 | 4.1 | — | — | 2.2 | — | — |
| | 15 | 100.0 | 0.0 | — | — | — | — | 0.0 | 0.0 | — | 60.8 | 18.4 | — | — | — | — | 1.4 | 19.4 | — |
| | 16 | 100.0 | 0.0 | — | — | — | — | 0.0 | 0.0 | — | 61.0 | 19.1 | — | — | — | — | 1.1 | 18.8 | — |
| | 17 | 100.0 | 0.0 | — | — | — | — | 0.0 | 0.0 | — | 62.5 | 17.3 | — | — | — | — | 0.9 | 19.3 | — |
| | 18 | 100.0 | 0.0 | — | — | — | — | 0.0 | 0.0 | — | 61.3 | 18.0 | — | — | — | — | 0.8 | 19.9 | — |
| CONVENTIONAL | 1 | — | — | — | — | — | — | — | — | — | 71.5 | — | 3.3 | — | — | — | 16.1 | 9.1 | — |
| CUTTING | 2 | — | — | — | — | — | — | — | — | — | — | — | — | — | — | — | — | — | — |
| INSERT | 3 | — | — | — | — | — | — | — | — | — | 69.4 | — | 19.6 | 6.8 | — | — | 4.2 | — | — |
| | 4 | — | — | — | — | — | — | — | — | — | — | — | — | — | — | — | — | — | — |
| | 5 | — | — | — | — | — | — | — | — | — | — | — | — | — | — | — | — | — | — |
| | 6 | — | — | — | — | — | — | — | — | — | 68.1 | 13.1 | — | — | 0.4 | — | 15.3 | 3.1 | — |

Sample nos. 1–18 represent cutting inserts of the present invention. Essentially, each of the samples is characterized by a binding phase and at least two coexisting hard dispersion phases. One of the two hard dispersion phases includes at least one of A' and A" while the other hard dispersion phase includes at least one of B' and B'.

It is clear from Tables 2–8 that samples 1–18 did not undergo any damage, such as breakage or chipping of the cutting edge. These results lend credence to the notion that TiCN-based cermet cutting inserts of the present invention are superior in toughness and wear resistance when compared to conventional samples 1–6, which contain at least one of a hard dispersion phase characterized by a duplex and/or a triplex structure with a core formed of a composite carbonitride solid solution alone and a hard dispersion phase of a single-phase structure formed of (Ti,M)CN.

Additionally, samples 1–18 exhibited excellent wear resistant during continuous cutting, when compared to conventional samples 1–6. This feature is made possible, in part, by the coexistence of at least one of A' and A" and at least one of B' and B" with the binding phase composed of at least one of Co and Ni.

As has been described, the TiCNobased cermet cutting insert of the present invention excels both in wear resistance and toughness. It exhibits improved resistance to wear and tear damage such as breakage and/or chipping of the cutting edge in continuous and discontinuous use. These features, in turn, impart excellent cutting properties to the cutting insert and substantially increase its life expectancy.

Having described preferred embodiments of the present invention, it is to be understood that the invention is not limited to those precise embodiments, and that various changes and modifications may be effected by one skilled in the art without departing from the scope or spirit of the invention as defined in the appended claims.

What is claimed:

1. A titanium carbonitride-based cermet cutting insert comprising: a binding phase;

from about 5 to about 30 volume percent of a binding phase including at least one of Ni and Co;

a balance substantially composed of a first hard dispersion phase and from 25 to 70 volume percent of one of a second and a third hard dispersion phase;

said first hard dispersion phase having at least one of a duplex and a triplex structure comprising a core of a composite carbonitride of a solid solution of Ti and at least one member selected from the group consisting of Ta, Nb, V, Hf, Zr, W, Mo and Cr;

said second hard dispersion phase having at least one of a duplex and a triplex structure comprising a core of titanium carbonitride; and said third hard dispersion phase having a single-phase structure of titanium carbonitride.

2. The cutting insert of claim 1, wherein said binding phase further includes, by weight percent, at least one of W, Mo, Cr, Hf, Zr, Ti, Ta, Nb and V in an amount no more than 40% with the balance being at least one Co and Ni.

3. A titanium carbonitride-based cermet cutting insert comprising:

from about 5 to about 30 volume percent of a binding phase consisting of at least one of Ni and Co;

a balance substantially composed of a first hard dispersion phase, a second hard dispersion phase and from 25 to 70 volume percent of a third hard dispersion phase;

said first hard dispersion phase having at least one of a duplex and a triplex structure comprising a core of a carbonitride of a solid solution of Ti and at least one element selected from the group consisting of Ta, Nb, V, Hf, Zr, W, Mo and Cr;

said second hard dispersion phase having a single-phase structure of a composite carbonitride of a solid solution of Ti and at least one element selected from the group consisting of Ta, Nb, V, Hf, Zr, W, Mo and Cr; and said third hard dispersion phase having at least one of a duplex and a triplex structure comprising a core of TiCN.

4. The cutting insert of claim 3, wherein said binding phase further includes, by weight percent, at least one of W, Mo, Cr, Hf, Zr, Ti, Ta, Nb and V in an amount no more than 40% with the balance being at least one Co and Ni.

5. A titanium carbonitride-based cermet cutting insert comprising:

from about 5 to about 30 volume percent of a binding phase consisting of at least one of Ni and Co;

a balance substantially composed of a first hard dispersion phase, a second hard dispersion phase, and from 25 to 70 vol % of one of a third hard dispersion phase and a fourth hard dispersion phase;

said first hard dispersion phase having at least one of a duplex and a triplex structure comprising a core of a composite carbonitride of a solid solution of Ti and at least one element selected from the group consisting of Ta, Nb, V, Hf, Zr, W, Mo and Cr;

said second hard dispersion phase having a single-phase structure having a composite carbonitride of a solid solution of Ti and at least one element selected from the group consisting of Ta, Nb, V, Hf, Zr, W, Mo and Cr;;

said third hard dispersion phase having at least one of a duplex and a triplex structure comprising a core of TiCN; and said fourth hard dispersion phase having a single-phase structure of titanium carbonitride.

6. The cutting insert of claim 5, wherein said binding phase further includes, by weight percent, at least one of W, Mo, Cr, Hf, Ti, Ta, Nb and V in an amount not exceeding 40% with the balance being at least one Co and Ni.

7. A titanium carbonitride-based cermet cutting insert comprising:

from about 5 to about 30 volume percent of a binding phase consisting of at least one of Ni and Co;

said binding phase further including, no more than 10 vol % of fine particles of TiN having an average particle size of from 0.5 to 2 μm;

a balance substantially composed of a first hard dispersion phase, a second hard dispersion phase, and from 25 to 70 vol % of one of a third hard dispersion phase and a fourth hard dispersion phase;

said first hard dispersion phase having at least one of a duplex and a triplex structure comprising a core of a carbonitride of a solid solution of Ti and at least one element selected from the group consisting of Ta, Nb, V, Hf, Zr, W, Mo and Cr;

said second hard dispersion phase having a single-phase structure having a composite carbonitride of a solid solution of Ti and at least one element selected from the group consisting of Ta, Nb, V, Hf, Zr, W, Mo and Cr;

said third hard dispersion phase having at least one of a duplex and a triplex structure comprising a core of TiCN; and said fourth hard dispersion phase having a single-phase structure of titanium carbonitride.

8. The cutting insert of claim 7, wherein said binding phase further includes, by weight percent, at least one of W, Mo, Cr, Hf, Zr, Ti, Ta, Nb and V in an amount no more than 40% with the balance being at least one Co and Ni.

9. The cutting insert of claim 7, wherein said binding phase includes, from about 0.1 to about 10 vol % of said fine particles of TiN dispersed therein.

10. A titanium carbonitride-based cermet cutting insert comprising:

from about 5 to about 30 volume percent of a binding phase comprising at least one of Ni and Co;

said binding phase further including, no more than 10 vol % of fine particles of TiN having an average particle size of from 0.5 to 2 μm;

a balance substantially composed of a first hard dispersion phase and from 25 to 70 volume percent of one of a second and a third hard dispersion phase:

said first hard dispersion phase having at least one of a duplex and a triplex structure comprising a core of a composite carbonitride of a solid solution of Ti and at least one member selected from the group consisting of Ta, Nb, V, Hf, Zr, W, Mo and Cr;

said second hard dispersion phase includes at least one of a duplex and a triplex structure having a core of titanium carbonitride; and said third hard dispersion phase including a single-phase structure of titanium carbonitride.

11. A titanium carbonitride-based cermet cutting insert comprising:

from about 5 to about 30 volume percent of a binding phase comprising at least one of Ni and Co;

said binding phase further including, no more than 10 vol % of fine particles of TiN having an average particle size of from 0.5 to 2 μm;

a balance substantially composed of a first hard dispersion phase, a second hard dispersion phase and from 25 to 70 volume percent of a third hard dispersion phase;

said first hard dispersion phase includes at least one of a duplex and a triplex structure comprising a core of a composite carbonitride of a solid solution of Ti and at least one element selected from the group consisting of Ta, Nb, V, Hf, Zr, W, Mo and Cr;

said second hard dispersion phase includes a single-phase structure formed of a composite carbonitride of a solid solution of Ti and at least one element selected from the group consisting of Ta, Nb, V, Hf, Zr, W, Mo and Cr; and said third hard dispersion phase includes at least one of a duplex and a triplex structure comprising a core of TiCN.

12. The cutting insert of claim 10, includes from 0.1 to 10 vol % of said fine particles of TiN having an average particle size of from 0.5 to 2 μm.

13. The cutting insert of claim 11, includes from 0.1 to 10 vol % of said fine particles of TiN having an average particle size of from 0.5 to 2 μm.

14. The cutting insert of claim 5, includes from 0.1 to 10 vol % of fine particles of TiN having an average particle size of from 0.5 to 2 μm.

15. The cutting insert of claim 2, further includes from 0.1 to 10 vol % of fine particles of TiN having an average particle size of from 0.5 to 2 μm.

16. The cutting insert of claim 4, further includes from 0.1 to 10 vol % of fine particles of TiN having an average particle size of from 0.5 to 2 μm.

17. The cutting insert of claim 6, further includes from 0.1 to 10 vol % of fine particles of TiN having an average particle size of from 0.5 to 2 μm.

* * * * *